US005297863A

United States Patent [19]

Richardson et al.

[11] Patent Number: 5,297,863

[45] Date of Patent: Mar. 29, 1994

[54] DISPLAY CASE WITH SHAPED LIGHTED SHELVES

[75] Inventors: Richard J. Richardson, Simi Valley; Charles E. Crown, San Fernando, both of Calif.

[73] Assignee: Anthony's Manufacturing Company, Inc., San Fernando, Calif.

[21] Appl. No.: 850,868

[22] Filed: Mar. 13, 1992

[51] Int. Cl.[5] ..... A47F 5/08; A47F 3/06

[52] U.S. Cl. ..... 312/128; 312/223.5; 211/153

[58] Field of Search ..... 312/128, 117, 118, 138.1, 312/223.5; 211/153, 134, 135

[56] References Cited

U.S. PATENT DOCUMENTS

| | | | |
|---|---|---|---|
| 2,496,221 | 1/1950 | Koch | 312/223.5 X |
| 2,628,877 | 2/1953 | Woo | 312/128 |
| 2,681,262 | 6/1954 | Vincent | 312/128 X |
| 2,703,743 | 3/1955 | Hardwood | 312/223.5 X |
| 2,883,252 | 4/1959 | Fitzgerald | 312/128 |
| 3,584,927 | 6/1971 | Ott et al. | 312/128 X |
| 3,821,538 | 6/1974 | Jonathon et al. | 312/128 X |
| 4,022,517 | 5/1977 | Eckert | 312/223.5 X |
| 4,955,044 | 9/1990 | Amstutz et al. | 312/223.5 X |
| 5,022,720 | 6/1991 | Fevig et al. | 312/223.5 |
| 5,180,222 | 1/1993 | Robinson | 312/223.5 X |

*Primary Examiner*—Kenneth J. Dorner
*Assistant Examiner*—Nancy Mulcare
*Attorney, Agent, or Firm*—Poms, Smith, Lande & Rose

[57] ABSTRACT

A display case having shaped lighted shelves which facilitate the illumination of lighting items placed on the shelves near the front and middle of the shelves. One such shaped shelf has a curved plate or rod attached at the front of the shelf which positions items placed near the front and middle of the shelf a selected distance toward the back of the shelf. As a result, items placed near the front and middle of the shaped shelves are illuminated better by fluorescent lighting tubes, mounted inside the display case near the ends of the shelves, than items placed near the front and middle of unshaped shelves. The display case may have shaped shelves having different degrees of curvature. Alternatively, the display case may have shelves that are shaped and unshaped.

12 Claims, 3 Drawing Sheets 18
20
22
23
24
25
32
34
46
47
48
49
50
51
52
53
54
56
58
7
8

DISPLAY CASE WITH SHAPED LIGHTED SHELVES

CROSS-REFERENCE TO RELATED APPLICATION

The subject matter of this application is related to the subject matter of copending application Ser. No. 07/865,096, filed with the present application, entitled "DISPLAY CASE WITH LENS LIGHTING SYSTEM," assigned to Anthony's Manufacturing Company, Inc., the assignee of the present application.

BACKGROUND OF THE INVENTION

The present invention relates generally to display cases with shelves, and more particularly to display cases having vertical lighting sources near the ends of each shelf.

In the past, a variety of shelves have been used inside display cases for the purpose of displaying different items in supermarkets, or other retail establishments. Items for sale are typically placed on top of the shelves in rows or columns. For example, dairy products in a supermarket may be placed on shelves inside a refrigerated display case with the older dairy products, which need to be sold first, located near the front and middle of the shelves where the products may be easily picked up by customers. However, problems are encountered in illuminating such products.

Products located near the middle of display shelves are difficult to illuminate when vertical, fluorescent tubes located near the ends of the shelves are used to light or illuminate the interior of a display case. In such a case, the products located near the lights receive more illumination than products located near the front and middle of the shelves. As a result, products near the middle of the shelves are improperly illuminated.

SUMMARY OF THE INVENTION

It is an object of this invention to provide a display case having shelves shaped to facilitate the illumination of items placed on the shelves near the front and middle of the shelves.

It is another object of this invention to provide a display case having different shaped shelves which allow certain items on certain shelves to be illuminated better than other items on other shelves.

It is still another object of this invention to provide a display case with shaped shelves that are economical to manufacture.

These and other objects and advantages are attained by a display case with shaped lighted shelves which facilitate the illumination of items placed on the shelves near the front and middle of the shelves. One such shaped shelf has a curved plate or rod attached at the front of the shelf which positions items placed near the front and middle of the shelf a selected distance toward the back of the shelf. As a result, items placed near the front and middle of the shaped shelves are illuminated better by fluorescent lighting tubes, mounted inside the display case near the ends of the shelves, than items placed near the front and middle of unshaped shelves. The display case may have shaped shelves having different degrees of curvature. Alternatively, the display case may have shelves that are shaped and unshaped.

The various features of the present invention will be best understood together with further objects and advantages by reference to the following description of the preferred embodiments taken in conjunction with the accompanying drawings.

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment, although it should be understood that various modifications can be accomplished within the parameters of the present invention.

Figure 1:
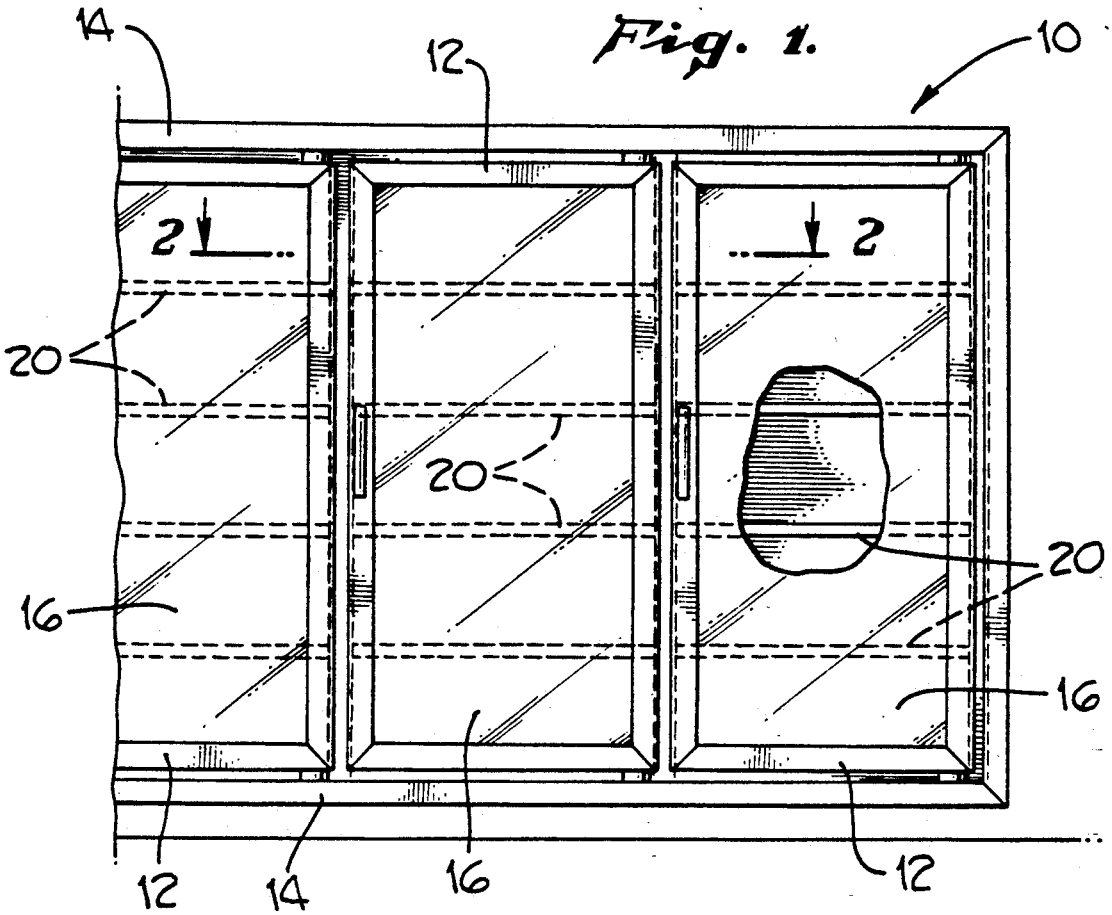
FIG. 1 is an elevational view of a display case of the present invention having doors mounted thereon and shelves mounted inside the case.

Referring to FIG. 1, a display case 10 of the present invention is shown having doors 12 mounted on a surrounding frame 14. The doors 12 have glass panels 16, which allow someone, such as a customer in a supermarket, to look through the panels 16 at items 18 displayed on shelves 20 inside the case 10. The items 18 inside the display case 10 may or may not be refrigerated items 18 such as frozen foods.

Figure 2:
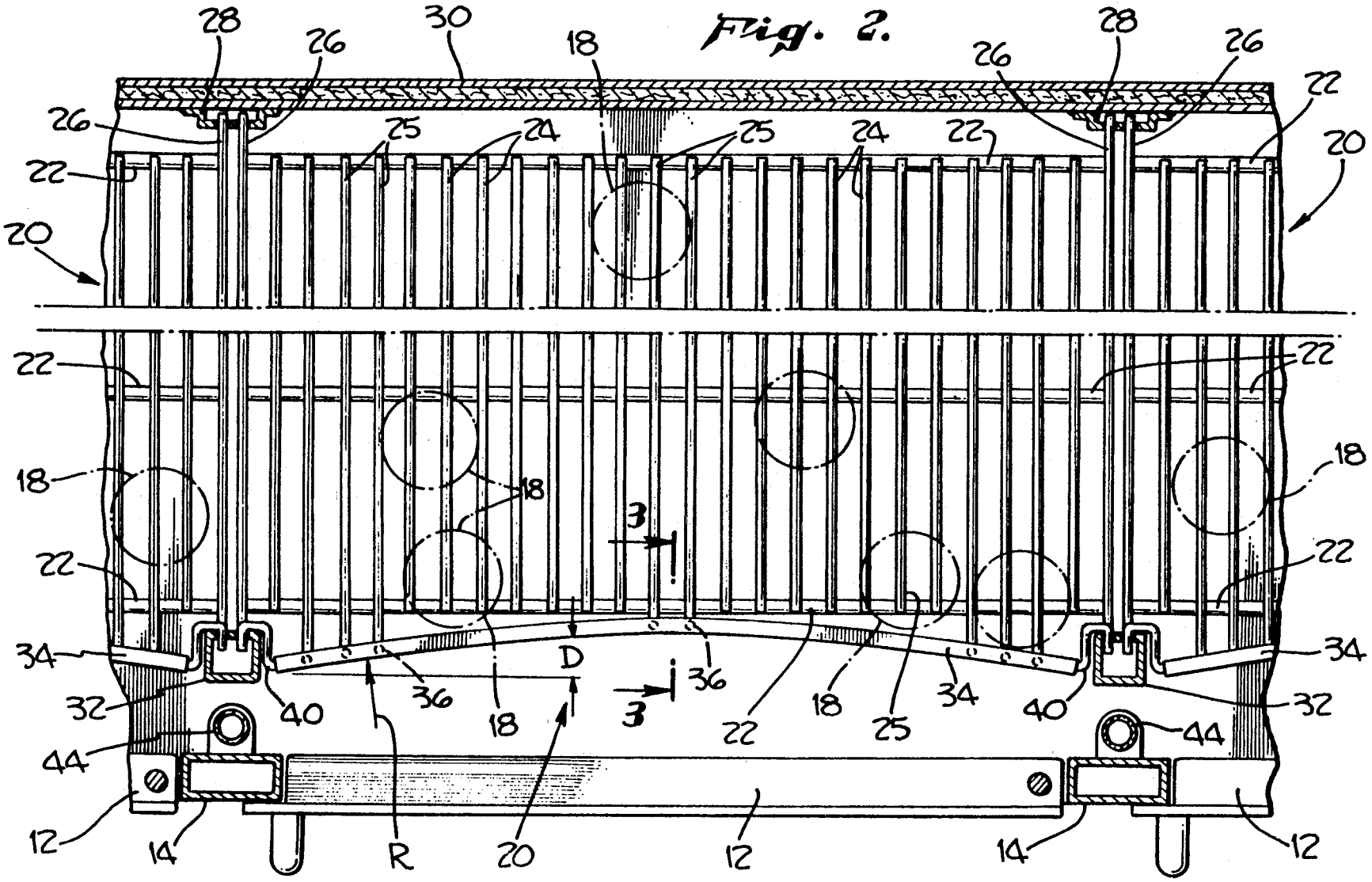
FIG. 2 is a partial cross-sectional view taken in the direction of arrows 2—2 of FIG. 1 showing shaped shelves which are curved and mounted at the same height or level inside the display case.

FIG. 2 shows adjacent shaped shelves 20 that are mounted at the same height or level within the display case 10. Each of the shaped shelves 20 has longitudinal supporting rods 22, transverse supporting rods 24 and 25, and end rods 26. The end rods 26 have ends thereof mounted in bracket supports 28 on the back wall 30 of the display case 10 and in column supports 32 in the case 10. However, it is important to note that the shelves 20 may use any other type of construction other than rods 22 and 24 through 26. For example, the shelves 20 may be constructed from sheet metal, may be injection molded, or the like.

Figure 3:
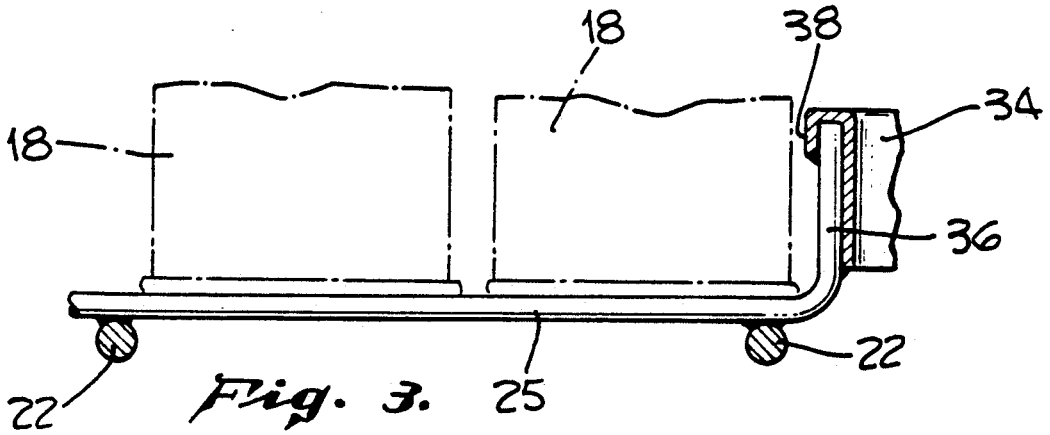
FIG. 3 is an enlarged cross-sectional view taken in the direction of arrows 3—3 of FIG. 2 showing how a curved front plate of one of the shaped shelves is mounted on supporting rods used for the shelf.

As shown in FIGS. 2 and 3, the shelves 20 have curved front plates 34 mounted on upwardly extending portions 36 of the transverse supporting rods 25. The curved plates 34 may have channels 38 which engage portions 36, and may be welded or otherwise attached to the rods 25. Hook members 40 at the ends of the curved plates 34 are used to attach the plates 34 to the column supports 32, as shown in FIG. 2. However, any desirable means may be used to mount the curved plates 34 to the rods 24 and column supports 32. Also, plates 34 may be made from sheet metal, may be injection molded, or may be made from any suitable material.

As illustrated in FIG. 2, the curved front plates 34 are curved inwardly so that a distance D exists at the middle of the plates 34, and may have a radius of curvature R.

It is important to note that the curved plates 34 may have any desirable curved shape. For example, an elliptical curvature may be used for the plates 34. However, the shaped shelves 20 may have any desirable shape. For example, the shaped shelves 20 may have a triangular shape, or any other desirable shape, so that the shelves 20 are shaped or curved inwardly toward the back of the display case 10, having a maximum inward distance (such as distance D shown in FIG. 2) near the middle of shelf 20, which decreases toward the ends of the shelf 20. "Shaped" as used herein means curved, jagged, fitted, having both shaped and unshaped portions, or otherwise formed.

Figure 4:
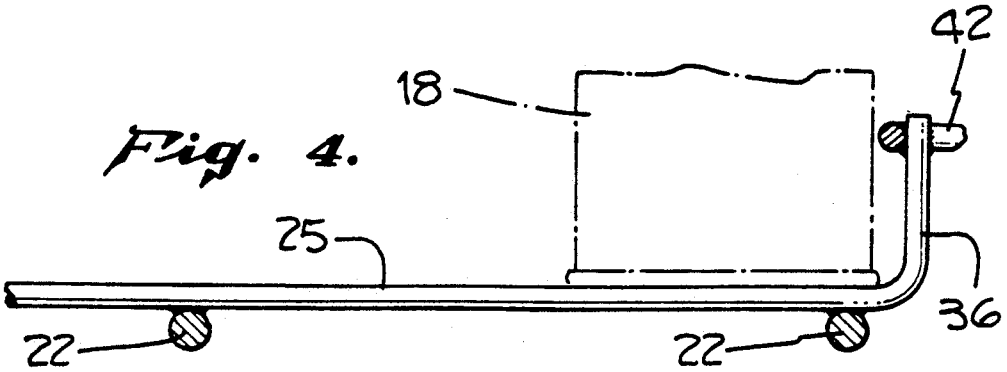
FIG. 4 is an enlarged cross-sectional view taken like FIG. 3 showing another embodiment of a shaped shelf using a curved front rod mounted on supporting rods of the shelf.

FIG. 4 shows another embodiment having a curved front rod 42 mounted at the front of the shelf 20 instead of the curved plate 34. The curved rod 42 may be welded or otherwise attached to upwardly extending portions 36 of the rods 25, and may be fabricated from metal, injection molded, or otherwise fabricated.

Figures 5, 6, 7, 8:
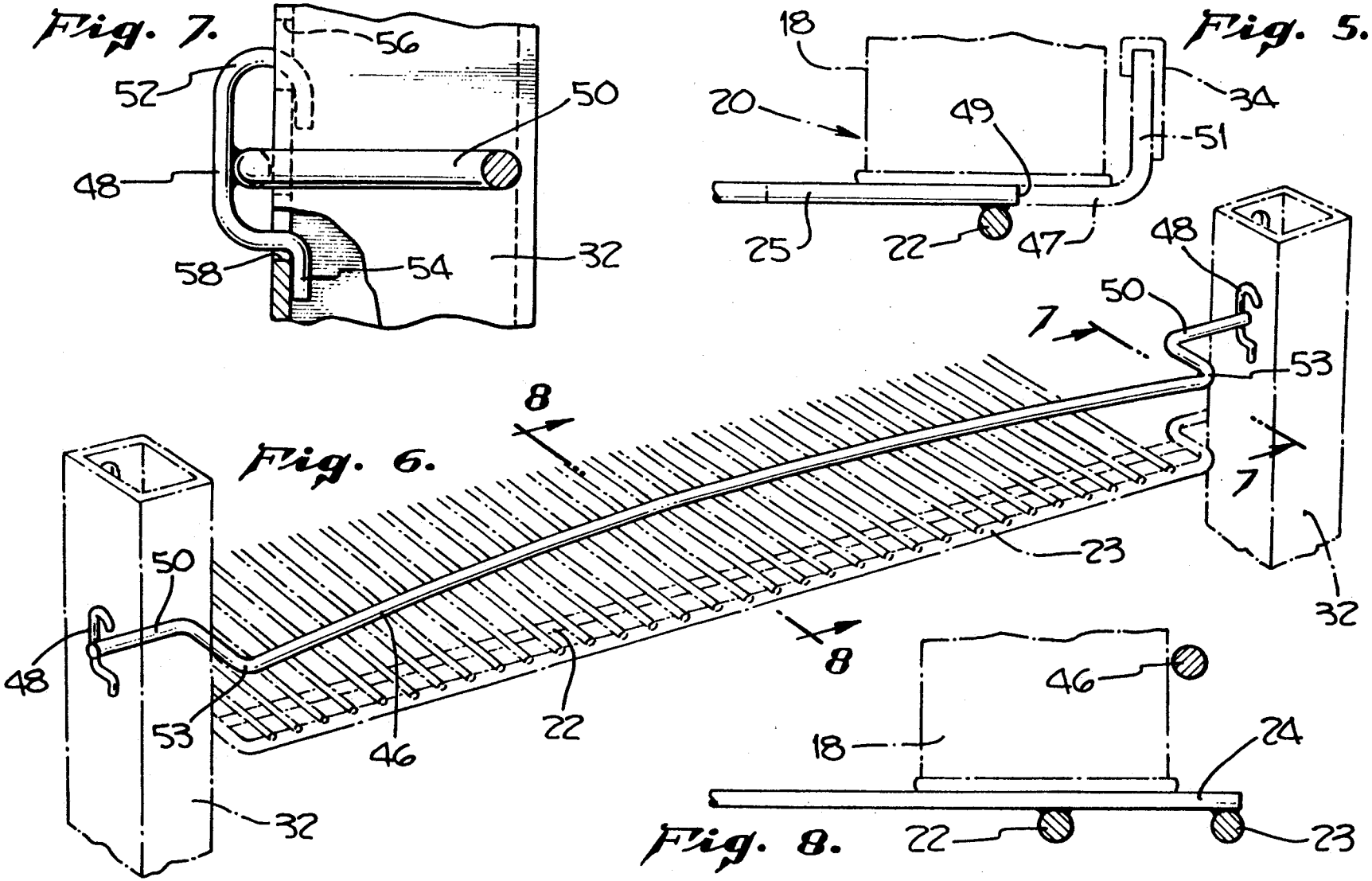
FIG. 5 is an enlarged cross-sectional view taken like FIG. 3 showing another embodiment of a shaped shelf having an extension attached to an existing shelf, the extension having a curved front plate mounted thereon.
FIG. 6 is a perspective view of another embodiment of a shaped shelf using a curved rod mounted in column supports.
FIG. 7 is an enlarged cross-sectional view taken in the direction of arrows 7—7 of FIG. 6.
FIG. 8 is an enlarged cross-sectional view taken in the direction of arrows 8—8 of FIG. 6.

FIG. 5 shows yet another embodiment of the shaped shelf 20 having an extension 47 that is attached to an existing shelf at end 49 by welds, fasteners or by any suitable fastening means. The existing shelf may be manufactured from rods 25, sheet metal, injection molded material, or the like. Likewise, extension 47 may be fabricated from, for example, rods such as rods 25, sheet metal, injection molded material or the like. Extension 47 has an upwardly extending portion or portions 51, and the curved plate 34 or curved rod 42 may be mounted on portion(s) 51. As such, existing shelves may be easily converted to the shaped shelves 20 of the present invention by use of extensions 47.

Still another embodiment of the shaped shelves 20 is shown in FIGS. 6 through 8, which has a curved rod 46 that is mounted above rods 24 on column supports 32 by hooked members 48 attached to the ends of the rod 46. Rod 46 preferably has an L-shaped portion 50 used to generally locate or align portions 53 of the rod 46 over front longitudinal rod 23 as shown in FIG. 6. However, rod 46 may be located at any desirable position relative to rod 23. Hooked members 48 preferably have hooked portions 52 and L-shaped portions 54 that engage apertures 56 and 58, respectively, in column supports 32. However, suitable fasteners or fastening means may be used to mount rod 46 to the column supports 32. Rod 46 may be used to convert existing shelves into the shaped shelves 20 of the present invention.

As can be seen from FIG. 2, items 18 placed near the front and middle of shelves in display cases are difficult to light or illuminate when vertical fluorescent lights or tubes 44, used to illuminate the cases, are located near the ends of the shelves, or near the front end corners of the shelves 20, as shown in FIG. 2. In such a case, items 18 located near the front of the shelves and close to the fluorescent tubes 44 will be illuminated better than items 18 which are placed farther away from the tubes 44 and near the front and middle of the shelves.

The lights 44 used for the display case 10 may be a number of separate tubes used for each level of shelves, or other types of lights used at different heights of the case.

The curved front plates 34 or rods 42 and 46 of the shelves 20 are used to position items 18 located at the front and middle of the shelves 20 a selected distance D toward the back of the shelves 20, so that these items 18, including front portions thereof, are lighted or illuminated better by the fluorescent tubes 44 located at the ends of the shelves 20 than items placed near the front and middle of shelves that do not have curved front plates 34 or rods 42 and 46. In the case of the shaped or curved shelves 20, the angle of incidence at which light strikes the front of items 18 located near the middle of the shelves 20, is greater than for shelves that are not shaped or curved.

As illustrated in FIG. 2, items 18 positioned at the front of the shelves 20 and closer to the tubes 44, or ends of the shelves 20, are located at distances toward the back of the shelves 20 that progressively decrease along the length of the shelves 20, reaching a minimum distance near the ends of the shelves 20. Items 18 placed against the curved plates 34 near the middle of the curved shelves 20 are more uniformly illuminated by the tubes 44 than items similarly placed on unshaped shelves, or the front portions of items 18 placed near the front and middle of the shaped shelves 20 are more uniformly lighted or illuminated by the tubes 44. In the case of shelves that are not shaped, the front portions of items positioned near the front and middle of the shelves, such as the flat front sides of box-shaped containers, may not be adequately illuminated by tubes 44 positioned at the ends of the shelves. The shaped shelves 20 of the invention solve this problem.

If items 18 are placed onto the display shelves 20 inside the display case 10 from the back of the display case 10, such as dairy products sold in a supermarket, then the curved plates 34 or rods 42 and 46 will prevent the items 18 near the middle of the shelves 20 from moving too far forward on the shelves 20, and will position the items 18 near the middle of the shelves 20 at a selected distance D as illustrated in FIG. 2. Therefore, items 18 may be properly positioned or loaded onto the shelves 20 from either the front or the back of the display case 10. If shaped shelves are not used, then items loaded onto the shelves from the back of the display case may be pushed too far forward near the middle of the shelves, resulting in inadequate illumination of these items.

The display case 10 may also have shelves 20 having different degrees of curvature, or that are shaped differently, or either or both of the parameters D and R may vary between the shelves 20 of the case. As a result, certain items 18 on some of the shelves 20 may be lighted or illuminated better than other items 18 on other shelves 20. This may be desirable, for example, if a store owner wishes to draw customers' attention to the items 18 that are illuminated better by the tubes 44. Also, it may be desirable to provide better illumination for more popular items 18 located on waist-high shelves 20 within easy reach of customers. In addition, the display case 10 may have both shaped shelves 20 and unshaped shelves. The less popular items 18 may be placed on the unshaped shelves. Also, some of the adjacent shelves at the same height or level in the display case 10

(having more than one door 12) may be shaped, and some may not be shaped.

It is important to point out that the fluorescent tubes 44 do not have to be located exactly at the ends of the shelves 20 of the display case 10. As such, the tubes 44 may be moved closer to or farther away from the middle of the shaped shelves 20. In addition, the fluorescent tubes 44 may be mounted on any part of the display case 10. Also, any suitable means of fastening, or any fasteners, other than hook members 40 and 48 may be used to connect the curved plates 34 or curved rods 42 and 46 to the column supports 32.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

We claim:

1. A display case used for displaying items, said case having lights mounted therein, said display case comprising:

a case structure; and at least one shelf mounted inside said case structure, each of said shelves having ends and front end corners, said lights being mounted near said front end corners, each of said shelves including:

a. a shelf portion used to support items, and b. means mounted at a front of said shelf portion for retaining a certain number of said items near a front and middle of said shelf so that said certain number of said items are substantially illuminated by said lights, said means being formed so that said certain number of said items are retained a selected distance from said front of said shelf portion toward the back of said shelf portion, said selected distance changing along a length of said shelf, reaching a minimum value near said ends of said shelf.

2. The display case of claim 1 wherein said means comprises a curved plate.

3. The display case of claim 1 wherein said means comprises a curved rod.

4. The display case of claim 1 wherein said lights are vertical fluorescent tubes located near said front end corners of said shelves.

5. A display case used for displaying items, said case having lights mounted therein, said display case comprising:

a case structure; and at least one shelf mounted inside said case structure, each of said shelves having ends, said lights mounted vertically near said ends, and including:

a. a shelf portion used to support items and b. a curved member mounted at a front of said shelf portion in order to retain a certain number of said items near a front and middle of said shelf so that front portions of said certain number of said items are substantially illuminated by said lights, said curved member being curved so that said certain number of said items are retained a selected distance from said front of said shelf portion toward the back of said shelf portion, said selected distance progressively decreasing along a length of said shelf, reaching a minimum value near said ends of said shelf.

6. The display case of claim 5, wherein said member is a curved plate.

7. The display case of claim 5, wherein said member is a curved rod.

8. The display case of claim 5 wherein said lights are fluorescent tubes.

9. A display case used for displaying items, comprising:

a case structure;

lights mounted inside said display case; and at least one shelf mounted inside said case structure, each of said shelves having ends and front end corners, and including:

a. a shelf portion used to support items, and b. a curved member mounted at a front of said shelf portion in order to retain a certain number of said items near said front of said shelf portion and near a middle of said shelf portion so that said certain number of said items are substantially illuminated by said lights, said lights being mounted near said front end corners of said shelves, said curved member being curved so that said certain number of said items are retained a selected distance from said front of said shelf portion toward the back of said shelf portion, said selective distance progressively decreasing along a length of said shelf, reaching a minimum valve near said ends of said shelf.

10. The display case of claim 9 wherein said lights are fluorescent tubes and are located near front end corners of said shelves.

11. The display case of claim 9 wherein said member is a curved plate.

12. The display case of claim 9 wherein said member is a curved rod.

* * * * *